United States Patent [19]

Garland et al.

[11] 3,991,650

[45] Nov. 16, 1976

[54] GUN SELF POWERED DRIVE SYSTEM

[75] Inventors: Newton C. Garland, Burlington; Victor R. Gardy, Shelburne; Lewis K. Wetzel, S. Burlington; August J. Haberstroh, N. Hero; Lawrence R. Folsom, Charlotte; Maurice P. Cloutier, S. Burlington; Peter L. Chamberlain, Underhill, all of Vt.

[73] Assignee: General Electric Company, Burlington, Vt.

[22] Filed: May 15, 1974

[21] Appl. No.: 470,088

[52] U.S. Cl. ..... 89/43 R; 89/126

[51] Int. Cl.[2] ..... F41F 19/02

[58] Field of Search ..... 89/126, 4, 45, 43, 162

[56] References Cited

UNITED STATES PATENTS

| | | | |
|---|---|---|---|
| 2,193,446 | 3/1940 | Caulkins | 89/43 R |
| 2,278,688 | 4/1942 | Caminez | 89/43 R X |
| 3,144,809 | 8/1964 | Girouad et al. | 89/4 |
| 3,146,672 | 9/1964 | Girouard et al. | 89/43 |
| 3,638,526 | 2/1972 | Klapdohr | 89/43 |
| 3,698,284 | 10/1972 | Toering et al. | 89/43 R |

*Primary Examiner*—Samuel W. Engle
*Assistant Examiner*—Ralph Palo
*Attorney, Agent, or Firm*—Bailin L. Kuch

[57] ABSTRACT

A gun drive system is provided wherein recoil motion is used to pump hydraulic liquid into an accumulator, which in turn, on demand, drives a hydraulic motor and the thereto coupled gun, discharging into a low pressure reservoir, which in turn, resupplies the pump chamber upon counter-recoil motion.

7 Claims, 7 Drawing Figures

Hydraulic Pump Adapters
Without Recoil Adapters
Gun Travel
.25 in/in
Force
50#/mm
Right Recoil Force
50#/mm
Left Recoil Force
Time Standard Recoil Adapters
Gun Travel
.25 in/in
Force
50#/mm
Right Recoil Force
50#/mm
Left Recoil Force

GUN SELF POWERED DRIVE SYSTEM

BACKGROUND OF THE INVENTION

1. Field of the Invention

This invention relates to automatic guns which are self powered.

2. Description of the Prior Art

Externally powered automatic gun systems conventionally have a reliability about one order of magnitude greater than that of self powered guns. In the heavier caliber machine guns, the self power is conventionally a recoil or gas operated direct drive system; while the external power is conventionally an electric motor, a ram air turbine drive or a hydraulic drive. This is true even for Gatling-type guns, which are continuous motion systems, and have been conventionally inherently more reliable than single barrel guns which are reciprocating systems. H. M. Otto in U.S. Pat. No. 2,849,921 shows a modern Gatling-type gun driven by an external electric motor. R. R. Bernard, et al in U.S. Pat. No. 3,311,022 and R. E. Chiabrandy in U.S. Pat. NO. 3,407,701 show modern Gatling-type guns driven by an internal gun gas piston. L. R. Folsom in U.S. Pat. No. 3,568,563 shows a modern Gatling-type gun wherein an internal gun gas vane motor biases a spring which drives the gun.

SUMMARY OF THE INVENTION

The best of both the self and externally powered systems are synthesized by capturing gun recoil energy in a hydraulic system, storing the energy and metering the energy out to an external motor to drive the gun as required, independently of the gun rate and functions. The advantage of this synthesis is that it allows all of the functions of the gun to be designed independently as an externally driven weapon, but still allows the gun to drive itself without depending on external sources of energy or interacting with its own immediate functions.

A feature of this invention is a gun whose recoil motion is used to pump hydraulic liquid from a pump chamber into an accumulator, which in turn, on demand, drives a hydraulic motor and the thereto coupled gun, discharging into a low-pressure reservoir, which in turn, resupplies the pump chamber upon counter-recoil motion.

BRIEF DESCRIPTION OF THE DRAWING

FIG. 3 is a chart of various system functions of the embodiment of FIG. 2;

DESCRIPTION OF THE INVENTION

Figure 1:
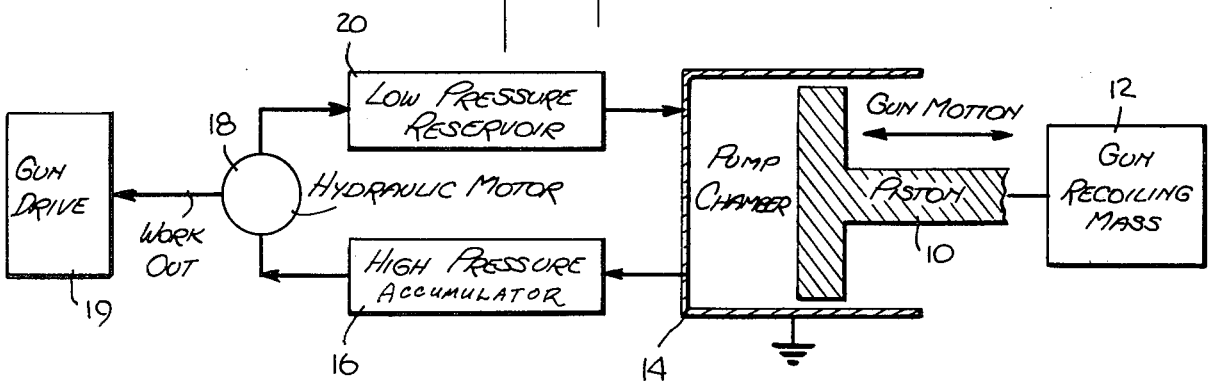
FIG. 1 is a schematic of the essentials of the invention.

As seen in FIG. 1, a pump piston 10 is coupled to and moves with the gun recoiling mass 12. The piston operates in a pump chamber 14 which is stationary with respect to the piston; and may conveniently be fixed to the gun mount while the piston is fixed to the gun housing. The pump chamber is part of a closed hydraulic loop including a high pressure accumulator 16, a hydraulic motor 18, and a low pressure reservoir 20. The pump converts the energy of the gun recoiling mass during recoil into hydraulic flow as kinetic energy. The resistance of the accumulator to the flow develops a hydraulic pressure or potential energy in the accumulator. The accumulator releases liquid under pressure to the hydraulic motor which provides work output into the gun drive 19. Energy depleted liquid from the motor is stored at low pressure in the reservoir and ultimately flows to the pump return on counter recoil. Although a fixed displacement, reciprocating pump is shown, other mechanical to hydraulic energy tranducers may be used.

Figure 2:
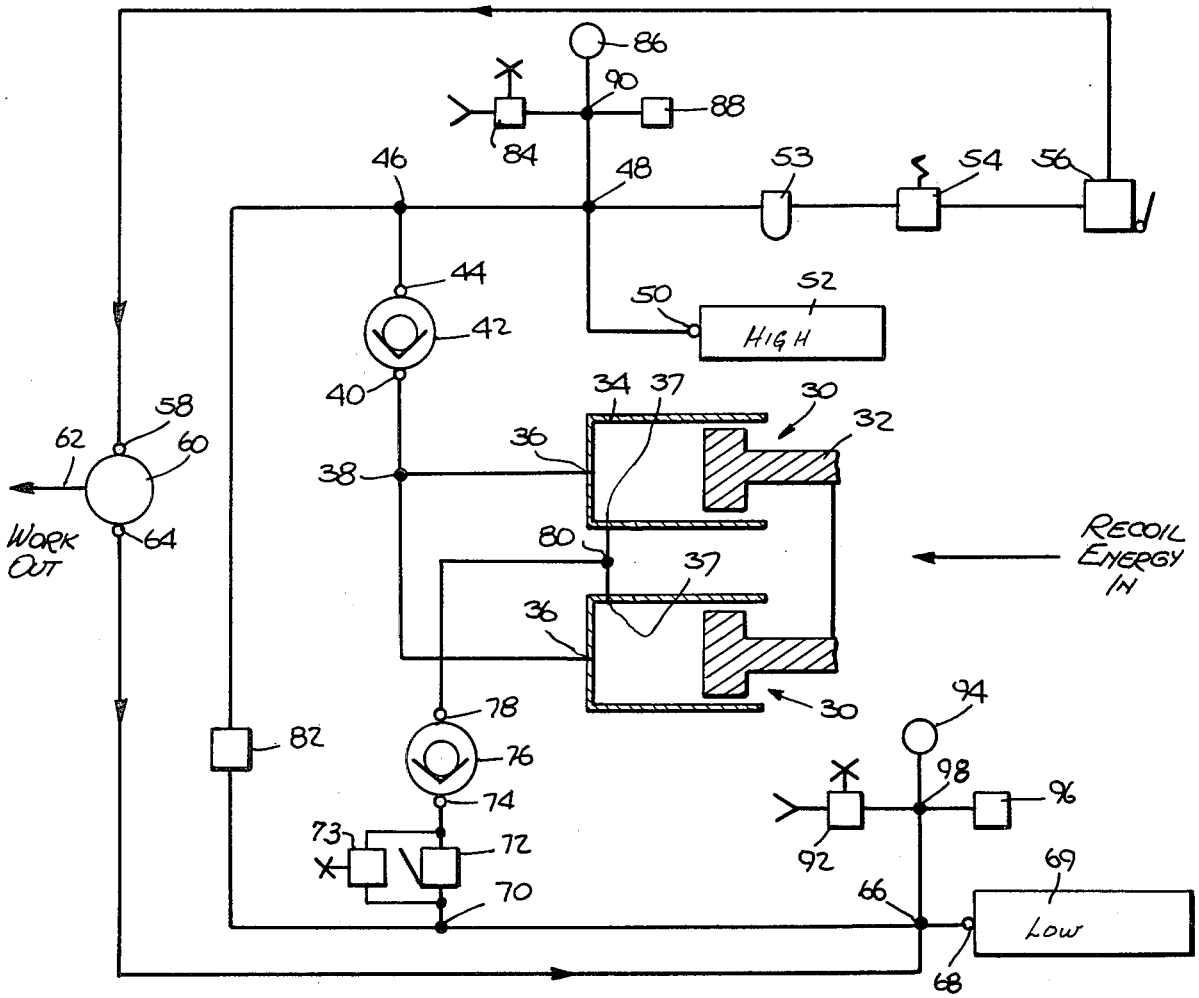
FIG. 2 is a detailed schematic of an embodiment of the invention.
Figure 9:
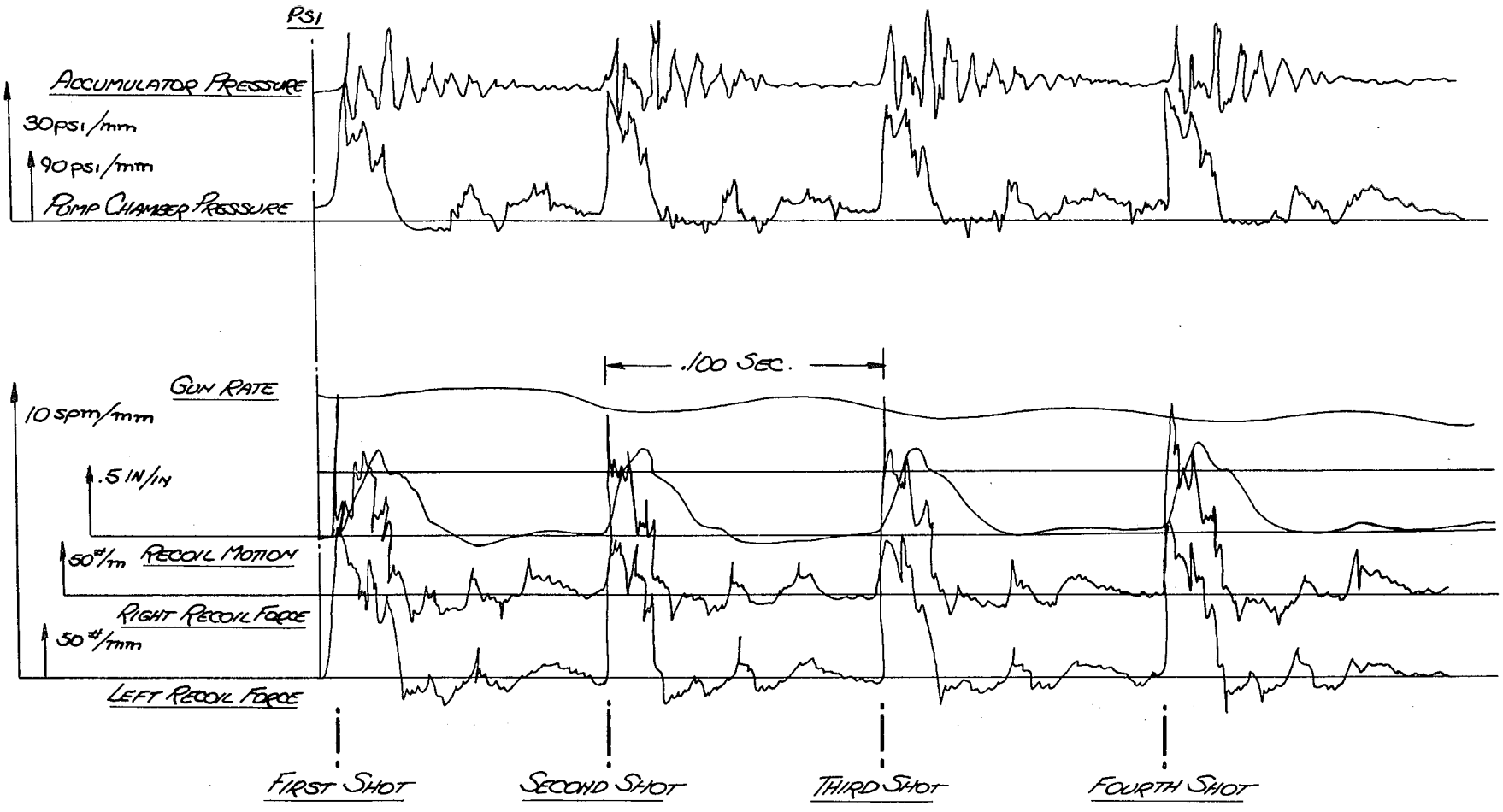

FIG. 2 shows an embodiment of this invention integrated with an M197, three barrel, 20mm, Gatling-type gun. Two, left and right, cylindrical, hydraulic pumps 30 are respectively mechanically coupled between the gun housing and the gun mount in lieu of the conventional left and right recoil adapters, the pistons 32 to the housing and the chambers 34 to the mount. The pumps' respective outlet ports 36 are hydraulically coupled in parallel at a junction 38 to the inlet port 40 of an unidirectional check valve 42 whose outlet port 44 is coupled via junctions 46 and 48 to the inlet/outlet port 50 of a high pressure accumulator 52. The port 50 is also coupled via the junction 48 through a hydraulic liquid filter 58, a solenoid operated valve 54, and an adjustable orifice flow controller 56 to the inlet port 58 of a hydraulic motor 60. The mechanical output drive 62 of the motor 60 is mechanically coupled to the gun through a conventional gearing, now shown. The outlet port 64 of the motor is coupled via a junction 66 to the inlet/outlet port 68 of a low pressure reservoir 69. The port 68 is coupled via the junction 66, a junction 70, through a hand pump 72, wich is shunted by a valve 73, to the inlet port 74 of a unidirerctional check valve 76, whose outlet port 78 is coupled via a junction 80 to the inlet ports 37 of the pair of pumps 30. An overpressure bypass relief valve 82 is shunted between the junctions 46 and 70. An inlet valve 84, a gage 86 and a transducer 88 are coupled via a junction 90 and the junction 48 to the high pressure accumulator 52. An inlet valve 92, a gage 94 and a transducer 96 are coupled via junctions 98 and 66 to the low pressure reservoir 69.

The valves 84 and 92 and the hand pump 72 are utilized to initially fill and pressurize the system with hydraulic liquid. Before firing, the accumulator 52 is pressurized, e.g. to 1500 psi and the reservoir 69 is pressurized, e.g. to 100 psi. This minimal pressure is set into the reservoir so as to provide a faster reaction time over that available from a vacuum replenishment system and to return the gun to battery position. The relief valve 82 is set to limit live pressure, e.g. to 1500 psi, by discharging the accumulator 52 into the reservoir 69. Sufficient energy is stored in the accumulator to provide gun start up power for a minimum burst length. Recoil energy from the gun is stored in the accumulator while concurrently energy, i.e. hydraulic liquid under pressure, is released from the accumulator to the motor 60. This release of hydraulic liquid to the drive is controlled by the solenoid valve 54 which is electrically coupled to the trigger of the gun. Hydraulic liquid from the motor is discharged to the reservoir, thereby replenishing the reservoir which is under minimal pressure and in turn replenishes the pump chamber and returns the pistons and the gun to battery position. This cycle continues ad infinitum with any excess energy developed by the pump discharging through the relief valve 82 into the reservoir at system equilibrium operation.

FIG. 3 illustrates the functions of the system with the M197 gun. At a gun firing rate of 600 spm, (or .100 sec. with respect to time) there are shown accumulator pressure in psi, pump chamber pressure in psi, recoil motions in inches, recoil force in pounds at the right gun mount and recoil force in pounds at the left gun mount.

The theoretical energy available from the gun recoil reaction, based on the impulse of 32 lb.-sec. for the 20mm ammunition fired and the weight of the recoiling mass of the M197 gun of 172 lbs. is 1,150 inch pounds per shot.

Figures 4, 5:
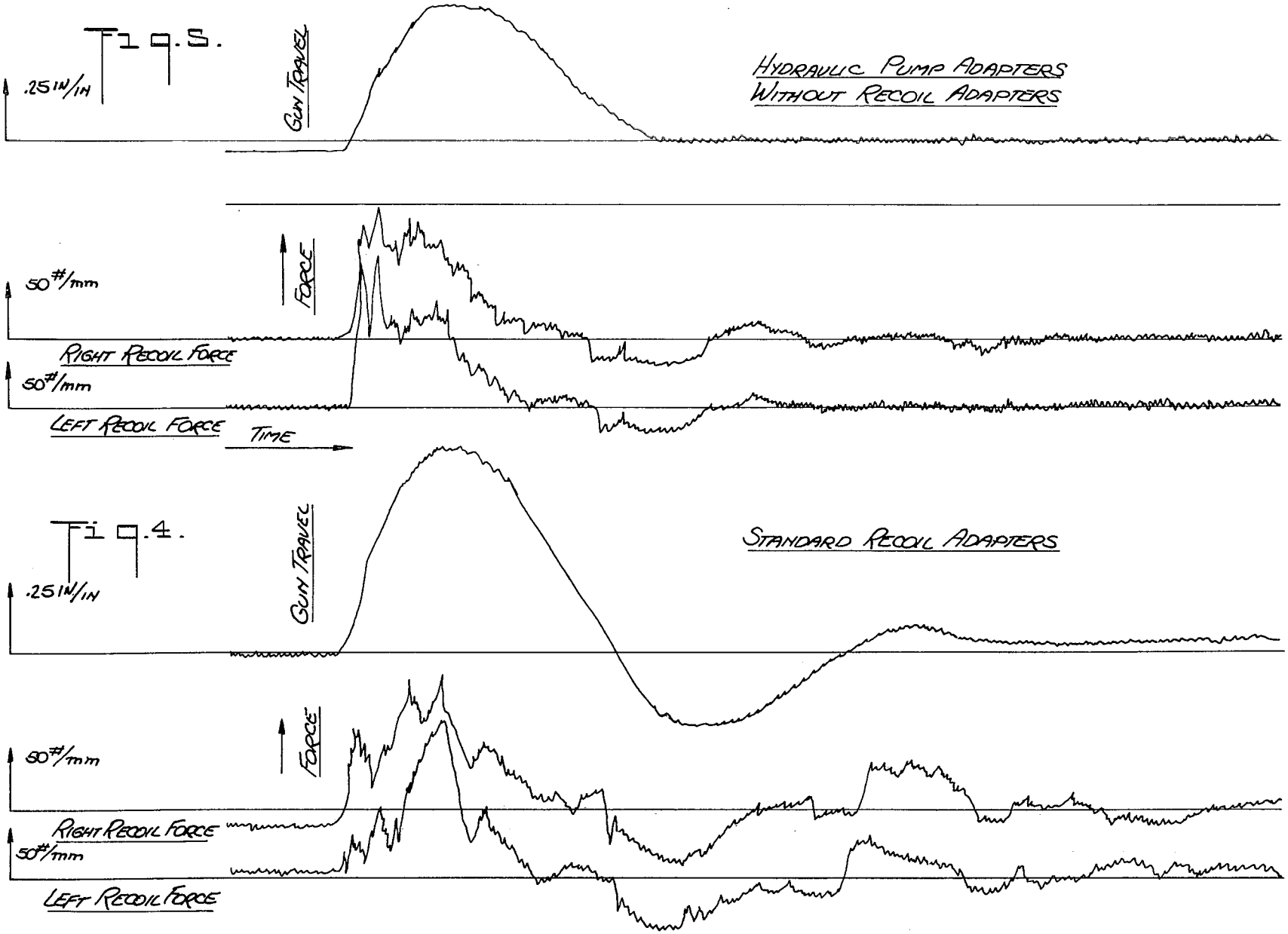
FIG. 4 is a chart of recoil forces and displacements of a gun mounted in conventional recoil adapters.
FIG. 5 is a chart of recoil forces and displacements of a gun mounted in the hydraulic system of FIG. 2.

The hydraulic pumps serve as superior adapters. FIG. 4 shows the gun motion and right and left recoil forces in an M197 gun mounted in conventional recoil adapters. FIG. 5 shows the gun motion and right and left recoil forces in a M197 gun mounted on the hydraulic pumps embodied in this invention. The hydraulic system provides higher damping with reduced counterrecoil force and displacement. This damping is provided by controlled hydraulic pressure losses in flow through the conduits and the check valves. The system shown in FIG. 2 may be utilized as per se hydraulic recoil adapter by omitting the drive circuit containing the motor 60, controller 56 and valve 54.

Although a single action piston pump has been described as convenient substitution for the conventional recoil adapter, other high efficiency pumps may be utilized and mechanically coupled between the recoiling gun mass and the stationary gun mount. For example, a vane type pump may be mechanically coupled by a rack and pinion. Similarly, the particular hydraulic motor utilized as the gun drive is a bent-axis, valveplate axial-piston pump, as such a pump is conventional on externally powered hydraulic gun drives, but other high efficiency motors may be utilized. An exemplary discussion of positive displacement pumps and accumulators may be found in "Machine Design," Sept. 14, 1972, published by the Penton Publishing Co., Cleveland, Ohio.

Alternatively, peak recoil forces can be minimized by using tapered pistons in the pumps to provide a varying flow area allowing a high initial flow and a subsequent restricted flow. This, in effect, levels out the peak forces.

Figure 6:
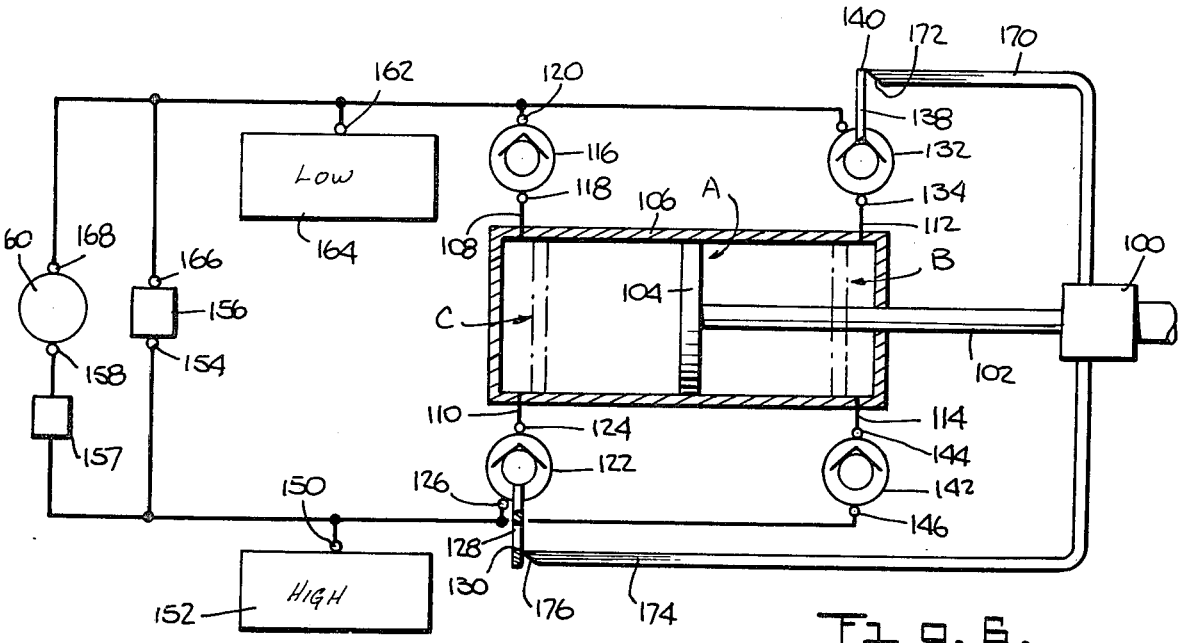
FIG. 6 is a schematic of a second embodiment of this invention.

The invention may incorporate a double acting pump as shown in FIG. 6. Here the gun recoiling mass 100 is fixed to a piston rod 102 whose distal end is fixed to a piston 104, both of which are suitably journaled and sealed in a pump chamber 106. The chamber has four ports therein, 108 and 110 at its aft end, and 112 and 114 at its forward end. A check valve 116 has an outlet 118 which is coupled to the port 108, and an inlet 120. A controlled check valve 122 has a normal inlet 124 which is coupled to the port 110, a normal outlet 126 and a control rod 128 having a cam follower surface 130. A controlled check valve 132 has a normal outlet 134 coupled to the port 112, a normal inlet 136 and a control rod 138 having a cam follower surface 140. A check valve 142 has an inlet 144 coupled to the port 114 and an outlet 146. The ports 146 and 126 are coupled in parallel to the inlet/outlet port 150 of a high pressure accumulator 152, to the inlet port 154 of an overpressure relief bypass valve 156, and through a solenoid valve 157 to the inlet port 158 of a hydraulic motor 160. The ports 136 and 120 are coupled in parallel to the inlet/outlet port 162 of a low pressure reservoir 164, to the outlet port 166 of the valve 156 and to the outlet port 168 of the motor 160. A control rod 170 is fixed to the piston rod 102 and has a cam surface 172 adapted to engage the cam follower surface 140 to open the valve 132. A control rod 174 has a cam surface 176 adapted to engage the cam follower surface 130 to open the valve 122.

In FIG. 6, the piston 104 is shown in its midposition "A", between its full battery position "B" (shown in phantom) and its full counter battery position "C" (shown in phantom). The hydraulic system is a closed system, and has its flows regulated and initially fed, bled and pressurized by suitable orifice pumps and valves as shown in FIG. 2.

When the gun is in battery, the piston is in its "B" position, the control rods 170 and 174 are clear of their controlled rods 138 and 128, all of the check valves are closed, and hydraulic liquid at low pressure is contained in the pump chamber aft of the piston. When the gun recoils, the solenoid valve 157 is opened by the trigger, the piston moves aft, progressively pressurizing the liquid in the chamber which opens the valve 122 to provide a flow of pressurized hydraulic liquid to the accumulator 152 and to the motor 160. The motor discharges the flow to the resevoir 164 and to the valve 132 which opens under the flow to pass liquid at a low pressure into the forward end of the chamber 106. When the aftward moving piston reaches its midpoint "A" of travel, the control rods 170 and 174 engage and hold open the valves 132 and 122. As the recoiling mass gradually runs out of momentum and as flow out of the port 110 is opposed by the pressure in the accumulator 152, the mass and the piston come to a hydraulically buffered half, with the piston at its aft position "C". The accumulator now provides flow of pressurized hydraulic liquid to both the motor to continue drive of the gun and to the aft end of the chamber via the held open valve 122, to move the piston forward. Liquid at low pressure is discharged from the right side of the chamber through the held open valve 132 to the reservoir 164. When the forwardly traveling piston reaches its midposition "A" the control rods 170 and 174 release and permit the valves 132 and 122 to close. The forward momentum of the recoiling mass 100 continues to drive the piston forward, with the valve 142 opening to release excess pressure as necessary from the right side of the chamber, and the valve 116 opening to admit low pressure liquid as necessary to the left side of the chamber, until the pressure differential across the piston is negligible and the piston and the mass come to a hydraulically buffered halt, with the piston at its forward position "B."

This system also provides a means of regulating the firing rate of the gun, by suitable selection of the design parameters of the system. If a shot is fired before the piston 104 reaches the position "B", the recoil mass has a counterrecoil velocity at the instant of firing and the recoil velocity provided by this shot is less than normal. This provides less than normal energy for storage in the accumulator 150 and ultimately for the drive motor 160. A firing rate exists for each set of design parameters at which the piston 104 would travel between the positions A through C through A and no net hydraulic energy would be stored in the accumulator.

THIRD EMBODIMENT

Figure 7:
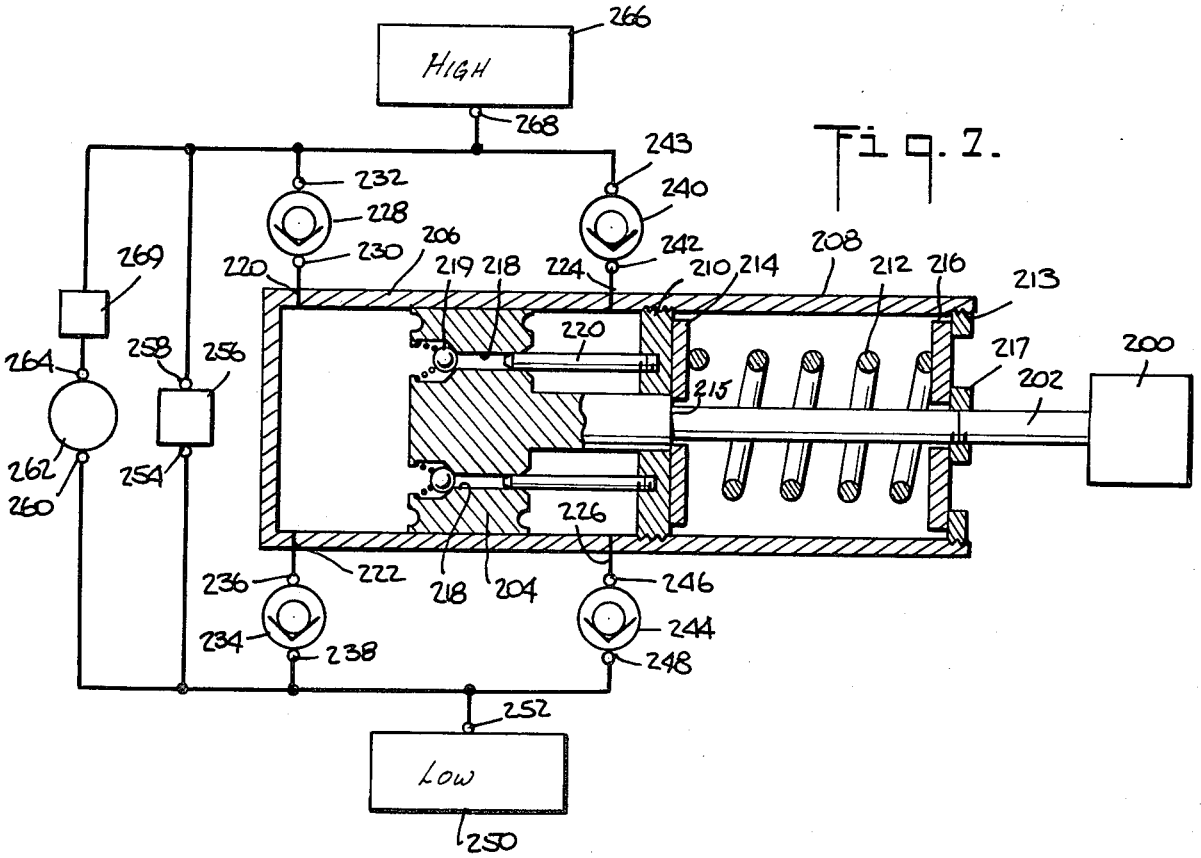
FIG. 7 is a schematic of a third embodiment of this invention.

The invention may also incorporate a double acting pump with an internal buffer spring as shown in FIG. 7. Here the gun recoiling mass 200 is fixed to a piston rod 202 whose distal end is fixed to a piston 204 both of which are suitably journaled and sealed in a pump chamber 206. The pump chamber has a forward extension 208, divided from the main chamber 206 by a transverse plate 210. A helical buffer spring 212 is captured between two washers 214 and 216 which are retained in the chamber extension by the plate 210 and a lock ring 213. The washers are carried on the rod 202 and captured between aft rod shoulder 215 and a forward rod collar 217. The piston has one or more longitudinal bores 218 therethrough, each of which has, at its respective aft end, a check valve 219 which permits aftward flow through the bore and precludes forward flow. One or more longitudinally aftwardly extending pins 220 are fixed to the plate 210 and each is adapted to obturate a respective bore 218 when the piston is at its midpoint of travel or forward thereof, and to clear the bore 218 when the piston is in its aftmost position.

The main chamber 206 has four ports therein, 220 and 222 at its aft end and 224 and 226 at its forward end. A check valve 228 has an inlet 230 which is coupled to the port 220, and an outlet 232. A check valve 234 has an outlet 236 which is coupled to the port 222, and an inlet 238. A check valve 240 has an inlet 242 which is coupled to the port 224 and an outlet 243. A check valve 244 has an outlet 246 coupled to the port 226 and an inlet 248. A low pressure reservoir 250 has an inlet port 252 which is coupled to the inlet port 248 of the check valve 244, to the inlet port 238 of the check valve 234, to the outlet port 254 of an overpressure relief valve 256 which also has an inlet port 258, and to the outlet port 260 of a hydraulic motor 262 which also has an inlet port 264. A high pressure accumulator 266 has an inlet/outlet port 268 which is coupled to the outlet port 243 of the check valve 240, to the outlet port 232 of the check valve 228, to the inlet port 258 of the overpressure relief valve 256, and through a solenoid valve 269 to the inlet port 264 of the motor 262.

This embodiment permits a reduction in peak recoil forces by firing out of battery at the point in the cycle with maximum counter-recoil velocity. This effect can be obtained with the spring recoil system tuned for the desired firing rate.

The recoil power generation is accomplished by the use of the double acting hydraulic cylinder in parallel with the double acting spring. The internal valving of the piston provides hydraulic damping during the desired portion of the cycle and the output from the hydraulic cylinder is connected to the accumulator. The valving is arranged to pump during the recoil stroke to provide heavy damping, but allowing storage of the recoil energy in the spring to provide the force required to return the gun to battery. There is no damping during the initial portion of the counter-recoil stroke to permit fast recuperation. The internal valving is positioned such that damping is then introduced, again pumping into the accumulator and halting forward motion of the gun prior to the firing of the next round.

As shown in FIG. 7, prior to firing the gun will be in battery, with the piston 204 centered in the chamber 206 by the double acting spring 212. The high pressure accumulator will have been initially charged, as by a preceding burst, or by an auxiliary pump, to provide starting power. Upon the first round being fired, the gun will recoil causing the piston 204 to move aftwardly, pumping liquid from the aft part of the cylinder through the valve 228 into the high pressure accumulator 266, while drawing liquid from the reservoir 250 through the valve 244 into the forward part of the cylinder. At the same time, the collar 217 and washer 216 compress the spring 212 against the plate 210, and the combination of spring force and of hydraulic damping through the valve 228 damps the recoil travel, bringing the recoiling mass to a halt. As the counter-recoil stroke begins, the valve 228 closes, and the liquid in the forward part of the chamber is pumped through the longitudinal passageways 218 and the valves 219 into the apt part of the chamber until the forward travel of the piston obturates the passageways 218 by the stationary pins 220. At this time the valve 240 opens and limits the buildup of pressure in the right part of the chamber to damp the piston to thereby hault the counter-recoil travel of the recoiling mass. This also adds high pressure liquid to the accumulator and adds to the useful power output. During both strokes, liquid will flow into the suction side of the cylinder as required through the appropriate valve 244 or 234 from the reservoir. When the gun is firing, the solenoid valve 269 permits the flow of liquid through the hydraulic motor from the accumulator to the reservoir.

It is contemplated that the inventive concepts hereinabove described may be variously otherwise embodied and combined without departing from the inventive principles included and intended to be covered by the appended claims, except insofar as limited by the prior art.

What is claimed is:

1. A gun driving system comprising:

a gun drive;

a gun recoiling mass;

a fixed support;

a hydraulic pump means including a group comprising a cylinder and a piston, one member of said group being coupled to said mass and the other member of said group being coupled to said support, whereby said piston has a battery position and a recoil stroke between said battery and recoil positions and a counter-recoil stroke between said recoil and battery positions, for pumping hydraulic liquid in response to movement of said mass relative to said support;

a hydraulic accumulator coupled to said cylinder for receiving hydraulic liquid under pressure therefrom;

a hydraulic liquid under pressure therefrom;

a hydraulic motor coupled to said accumulator for receiving hydraulic liquid under pressure therefrom;

a hydraulic reservoir coupled to said motor for receiving hydraulic liquid therefrom, and coupled to said cylinder for providing hydraulic liquid thereto;

said system having a mode of operation wherein said piston pumps hydraulic fluid under pressure into said accumulator and said motor through substantially the full length of said recoil stroke;

a gun trigger; and a first valve coupled to and between said accumulator and said motor and to said trigger, for normally blocking the flow of liquid from said accumulator to said motor, and upon actuation of said trigger permitting such flow to drive said motor.

2. A system according to claim 1 wherein:

said piston moves aft, into said cylinder during recoil of said recoiling mass, said cylinder has a liquid inlet means and a liquid outlet means adjacent the aft side of said piston, said outlet means being coupled to said accumulator, said inlet means being coupled to said reservior, said motor being coupled to and between said accumulator and said reservoir;

having a mode of operation wherein said reservoir is pressurized by flow of liquid from said motor and serves to drive said piston in counter recoil.

3. A system according to claim 1 wherein:

said piston means aft into said cylinder during recoil of said recoiling mass, a first check valve coupling the aft end of said cylinder to said accumulator and said motor, and normally permitting flow from said cylinder and precluding flow into said cylinder;

a second check valve coupling the forward end of said cylinder to said accumulator and said motor, and normally permitting flow from said cylinder and precluding flow into said cylinder;

a third check valve coupling said aft end of said cylinder to said reservoir and said motor, and normally permitting flow into said cylinder and precluding flow from said cylinder;

a fourth check valve coupling said aft end of said cylinder to said reservoir and said motor, and normally permitting flow into said cylinder and precluding flow from said cylinder;

first control means operable when said piston is disposed in substantially the aft half of said cylinder to cause said first check valve to permit flow into said aft end of said cylinder;

second control means operable when said piston is disposed in substantially the aft half of said cylinder to cause said fourth check valve to permit flow into said forward end of said cylinder.

4. A system according to claim 1 wherein:

said piston moves aft said cylinder during recoil of said recoiling mass;

a first check valve coupling the aft end of said cylinder to said accumulator and said motor, and normally permitting flow from said cylinder and precluding flow into said cylinder;

a second check valve coupling the forward end of said cylinder to said accumulator and said motor, and normally permitting flow from said cylinder and precluding flow into said cylinder;

a third check valve coupling said aft end of said cylinder to said reservoir and said motor and normally permitting flow into said cylinder and precluding flow from said cylinder;

a fourth check valve coupling said aft end of said cylinder to said reservoir and said motor, and normally permitting flow into said cylinder and precluding flow from said cylinder;

a fifth check valve coupling said aft end of said cylinder to said forward end of said cylinder, and normally permitting flow from said aft end to said forward end and precluding flow from said forward end to said aft end;

first control means operable when said piston is disposed in substantially the forward half of said cylinder to preclude said fifth check valve from permitting flow from said forward end to said aft end of said cylinder; and spring means coupled to and between said recoiling mass and said cylinder, for receiving energy from said recoiling mass during the recoil stroke and for providing energy to said recoiling mass during the counter-recoil stroke.

5. A gun driving system comprising:

a gun drive;

a gun recoiling mass;

a fixed support;

a hydraulic pump means including a group comprising a cylinder and a piston, one member of said group being coupled to said mass and the other member of said group being coupled to said support, whereby said piston has a battery position and a recoil position and a recoil stroke between said battery and recoil positions and counter-recoil stroke between said recoil and battery positions, for pumping hydraulic liquid in response to movement of said mass relative to said support;

a hydraulic accumulator coupled to said cylinder for receiving hydraulic liquid under pressure therefrom;

a hydraulic motor coupled to said accumulator for receiving hydraulic liquid under pressure therefrom;

a hydraulic reservoir coupled to said motor for receiving hydraulic liquid therefrom, and coupled to said cylinder for providing hydraulic liquid thereto;

said system having a mode of operation wherein said piston pumps hydraulic fluid under pressure into said accumulator and said motor through substantially the full length of said recoil stroke; and means for prepressurizing said accumulator to a relatively high pressure and for prepressurizing said reservoir to a relatively low pressure.

6. A gun driving system comprising:

a gun drive;

a gun recoiling mass;

a fixed support;

a hydraulic pump means including a group comprising a cylinder and a piston, one member of said group being coupled to said mass and the other member of said group being coupled to said support, whereby said piston has a battery position and a recoil position and a recoil stroke between said battery and recoil positions and a counter-recoil stroke between said recoil and battery positions, for pumping hydraulic liquid in response to movement of said mass relative to said support;

a hydraulic accumulator coupled to said cylinder for receiving hydraulic liquid under pressure therefrom;

a hydraulic motor coupled to said accumulator for receiving hydraulic liquid under pressure therefrom;

a hydraulic reservoir coupled to said motor for receiving hydraulic liquid therefrom, and coupled to said cylinder for providing hydraulic liquid thereto;

said system having a mode of operation wherein said piston pumps hydraulic fluid under pressure into said accumulator and said motor through substantially the full length of said recoil stroke; and said pump means includes a pair of symmetrical pumps coupling said gun to its support.

7. A driving system for an internal combustion engine comprising:

a drive for said engine, an engine reciprocating mass, a fixed support for said engine;

a hydraulic pump means including a group comprising a cylinder and a piston, one member of said group being coupled to said mass and the other member of said group being coupled to said support, whereby said piston has a forward position and an aft position and an aftward stroke between said forward and aft positions and a forward stroke between said aft and forward positions, for pumping hydraulic liquid in response to movement of said mass relative to said support;

a hydraulic accumulator coupled to said cylinder for receiving hydraulic liquid under pressure therefrom;

a hydraulic motor coupled to said accumulator for receiving hydraulic liquid under pressure therefrom;

a hydraulic reservoir coupled to said motor for receiving hydraulic liquid therefrom, and coupled to said cylinder for providing hydraulic liquid thereto;

said motor being coupled to said drive for driving said drive;

said system having a mode of operation wherein said piston pumps hydraulic fluid under pressure into said accumulator and said motor through substantially the full length of said aftward stroke;

a switch; and a first valve coupled to and between said accumulator and said motor and to said trigger, for normally blocking the flow of liquid from said accumulator to said motor, and upon activation of said trigger permitting such flow to drive said motor.

* * * * *